United States Patent [19]

Cappis

[11] 4,449,654

[45] May 22, 1984

[54] BELT SUPPORTED BACKPACK

[76] Inventor: Lona P. Cappis, 30 Glenview Ct., Los Alamos, N. Mex. 87544

[21] Appl. No.: 338,277

[22] Filed: Jan. 11, 1982

Related U.S. Application Data

[63] Continuation-in-part of Ser. No. 217,859, Dec. 18, 1980, abandoned.

[51] Int. Cl.[3] ..... B65D 23/08

[52] U.S. Cl. ..... 224/148; 224/224; 224/223; 224/250

[58] Field of Search ..... 224/224, 223, 148, 203, 224/919, 250; 206/427; 2/312, 318, 319, 320, 323

[56] References Cited

U.S. PATENT DOCUMENTS 984,768 2/1911 Le Claire ..... 224/224 X
2,524,639 10/1950 Saunders ..... 224/250 X
3,497,118 2/1970 Najjar ..... 224/919 X
4,069,954 1/1978 Rauch ..... 224/223 X

*Primary Examiner*—Steven M. Pollard
*Attorney, Agent, or Firm*—E. C. Walterscheid

[57] ABSTRACT

A belt-supported backpack adapted to provide ready access and replacement of bottles or other containers for liquid. An elongated flexible belt has a plurality of open topped and open bottomed flexible pockets affixed thereto. Means are provided for supporting bottles or other objects carried in these pockets. The center section of the belt is relatively wide and rectangular and merges into tapered sections. The tapered and rectangular sections of the belt are preferably formed of two panels affixed in mirror image. A zipper opening is provided to the rectangular flat compartment formed between the panels. A plurality of small ties or straps are provided within this compartment for tying items to the backpack when the zipper is open.

11 Claims, 4 Drawing Figures

BELT SUPPORTED BACKPACK

CROSS REFERENCE TO RELATED APPLICATION

This application is a continuation-in-part of an earlier-filed, copending application Ser. No. 217,859 also entitled "Belt Supported Backpack" which was filed Dec. 18, 1980, now abandoned.

BACKGROUND OF THE INVENTION

This invention relates to belt-supported backpacks and more particularly to a belt-supported backpack adapted for carrying a plurality of liquid containers and providing ease of access to said containers while the person wearing the backpack is in motion.

Various types of sports activity in which the participants traverse long distances while staying in continuous motion have become increasingly popular. Persons engaging in such activity, such as long distance runners and joggers and cross country skiers, tend to loose significant amounts of fluids during their marathon events and consequently require some means of replenishing their body fluids during the course of their activity. Since the whole point of their exercise is to continue in motion throughout the length of their activity, it is apparent that they find it highly desirable to have some means of carrying liquids which are easily accessible for drinking while they are engaged in their long distance activity. It is also highly important to them that whatever means is used to carry such liquids must provide minimal interference with their long distance activity.

The requirements for ease of access and minimal interference with activity strongly dictate that the means for carrying the liquids be belt supported. Belt-supported backpacks adapted to be used for a variety of purposes are known. Such packs are designed to be used at either waist or hip level with those particularly designed to be used at hip level frequently being referred to as "fanny" packs. These packs typically have one or more compartments for carrying equipment, supplies, food, etc. and some are touted as permitting ease of compartmental access without removal of the pack from the back. In addition, various types of utility belts have been devised with pockets or small compartments to permit carrying of small articles of equipment. Finally, a variety of belt-supported canteens are known.

None of these belt-supported packs or canteens, however, meet the criteria of ease of access to the liquids while the wearer is in motion or of minimum interference with the activity of the wearer.

SUMMARY OF THE INVENTION

It is accordingly an object of the present invention to provide a belt-supported backpack adapted for use by long-distance runners and cross-country skiers.

It is another object of this invention to provide a belt-supported backpack adapted to carry a plurality of containers for liquid and provide ready access to these containers while the wearer is in motion.

It is a further object of the invention to provide a belt-supported backpack which may readily be worn at waist level without undue rubbing or chafing against the pelvic bone of the wearer.

It is an additional object of the invention to provide a belt-supported backpack having a plurality of readily accessible pockets with quick release fasteners for carrying containers for liquid or other items.

In its broad sense, the present invention is directed to a belt-supported backpack which is adapted to be secured around the midriff of the wearer and which comprises the following combination of elements. An elongated flexible belt is provided which has a relatively wide intermediate section and sections tapering from this intermediate section to straps forming the free ends of the belt. Fastener means are provided on at least one of the free ends of the belt for releasing and adjustably securing the free ends together. A plurality of substantially vertical, substantially equally spaced, open topped pockets are affixed to the intermediate portion of the belt. These pockets are adapted to provide easy access for removal and replacement of items carried therein by the person wearing the pack while this person is running, walking, or skiing.

In the preferred embodiment, the pockets are also open bottomed and items carried therein are supported by at least one strap affixed across the open bottom of each pocket. In addition, the intermediate and tapered regions of the belt are formed by two panels affixed together in mirror image with a zippered opening along the top to form a flat compartment. Small straps or ties are provided at spaced intervals just below the zipper in this compartment. Straps are provided which pass diagonally across the top of each pocket to secure bottles or other items carried therein. Finally, the bottom taper on each of the tapered sections is shaped to permit the belt to be worn at waist level without undue rubbing or chafing on the pelvic bone.

In an alternative embodiment, the pockets are also open bottomed and items carried therein are supported by a shelf affixed to the base of the intermediate region of the belt and held in a desired, spaced relationship to the pockets by straps affixed thereto.

Additional objects, advantages, and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DESCRIPTION OF THE PREFERRED EMBODIMENT

Figure 1:
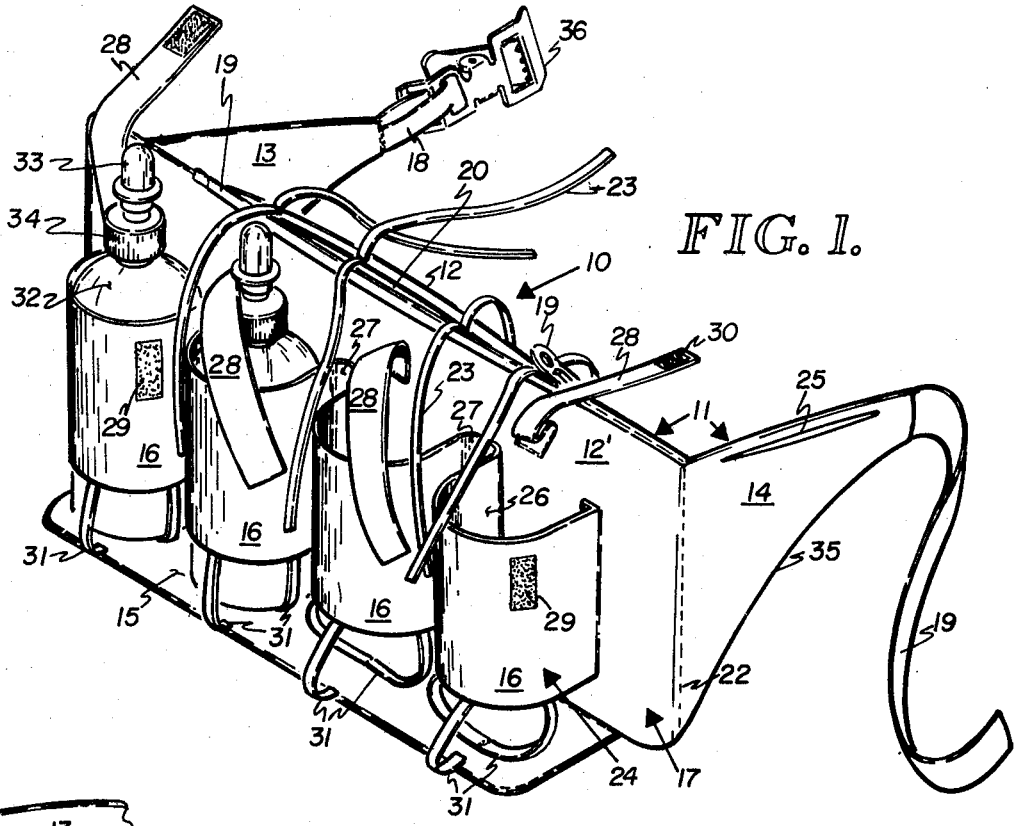
FIG. 1 is a perspective view of the backpack of the invention in one embodiment.
Figure 2:
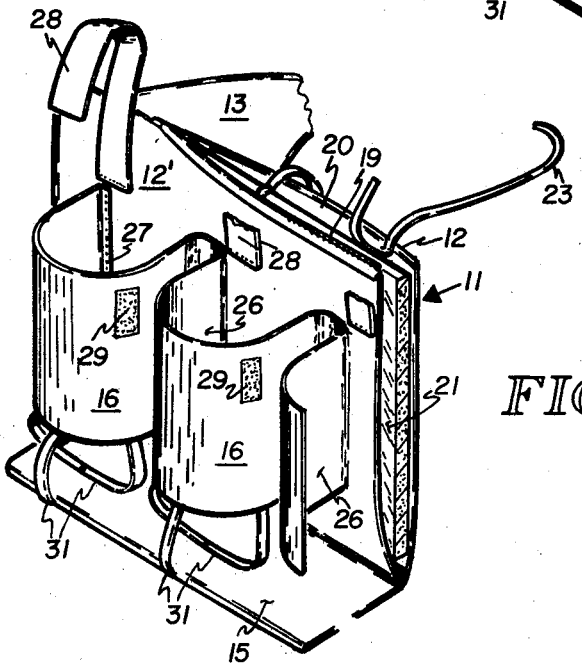
FIG. 2 is a cutaway view showing certain details of the flat compartment within the belt of the backpack in one embodiment.
Figure 3:
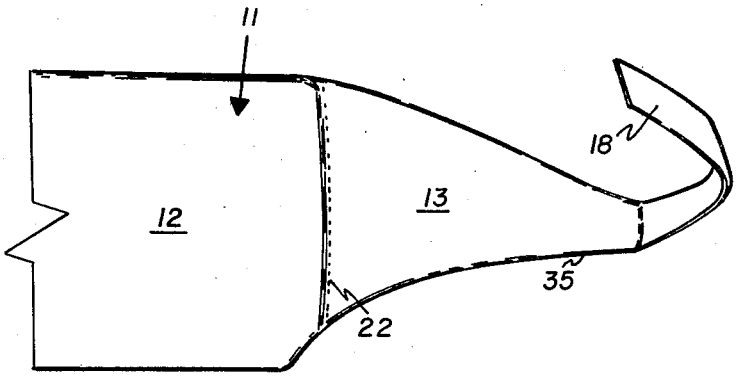
FIG. 3 is a partial back view of the belt of the backpack.

As shown in the drawings, a preferred embodiment of the belt-supported backpack of the present invention broadly comprises belt 10, a plurality of open topped, open bottomed pockets 16, and means for holding desired items in said pockets 16. Belt 10 in turn is composed of interior panel 11, exterior panel 17, straps 18 and 19, and clamping buckle 36. It will be apparent that interior panel 11 is a mirror image of exterior panel 17.

Panels 11 and 17 have a rectangular center section 12 which forms the relatively wide intermediate section of belt 10. Center section 12 merges at opposite ends into tapering sections 13 and 14. Each panel is formed by a single elongated length of flexible material. While panels 11 and 17 may be made from any of a variety of suitable materials, a woven Nylon fabric sold under the tradename Cordura by Du Pont has been found to be quite useful. Panels 11 and 17 may be joined by any conventional technique with stitching being preferred. Because interior panel 11 is in contact with the back and waist of the wearer, it is desirable that panels 11 and 17 be joined in such a fashion that there is no seam facing the wearer.

A zipper member 19 is used to join the upper portion of center sections 12 and 12' of panels 11 and 17. Zipper 19 provides access to flat compartment 20 formed between sections 12 and 12' by means of vertical stitching 22 joining panels 11 and 17. A foam cushion pad 21 is preferably inserted in compartment 20 to provide a cushion between the contents of pockets 16 and the wearer. Compartment 20 may readily be used for carrying relatively flat items such as trail maps and other papers. Because of the good water resistant properties of the preferred panel material, Cordura, compartment 20 can be used to protect papers and other items from exposure to moisture. A plurality of small straps or ties 23 may be fastened along the length of compartment 20 just inside zipper 19. In the preferred embodiment of the drawing, four such ties 23 are shown. Ties 23 may advantageously be used to attach any desired item to the backpack, but have been found to be particularly useful for attaching items of clothing such as a jacket or windbreaker.

A primary purpose of the backpack, namely, carrying readily accessible containers of liquid with minimal interference to the wearer, is performed by pockets 16. Pockets 16 are preferably formed from a single length 24 of flexible material which is pleated to form loops 26 of the desired circumference which are affixed by vertical stitching 27 to intermediate or center section 12' of exterior panel 17. Again Cordura has been found quite suitable for this purpose. It is important to note that pockets 16 are open topped so that containers for liquid or other items desired to be transported therein may be easily inserted and removed.

Bottles or other items carried therein are readily held in place by straps 28 affixed to section 12' of panel 17 such that each individual strap 28 can be passed diagonally across the opening in the top of each pocket 16 and fastened to the exterior of the loop 26 forming the pocket by appropriate fastening means. It is desirable that such fastening means be of the quick release variety. Appropriate for this purpose are fastening means of the type sold under the tradename Velcro consisting of a first strip of thistle cloth 29 affixed to pockets 16 and a second strip of thistle cloth hooks 30 affixed to the inside of the free ends of straps 28.

Figure 4:
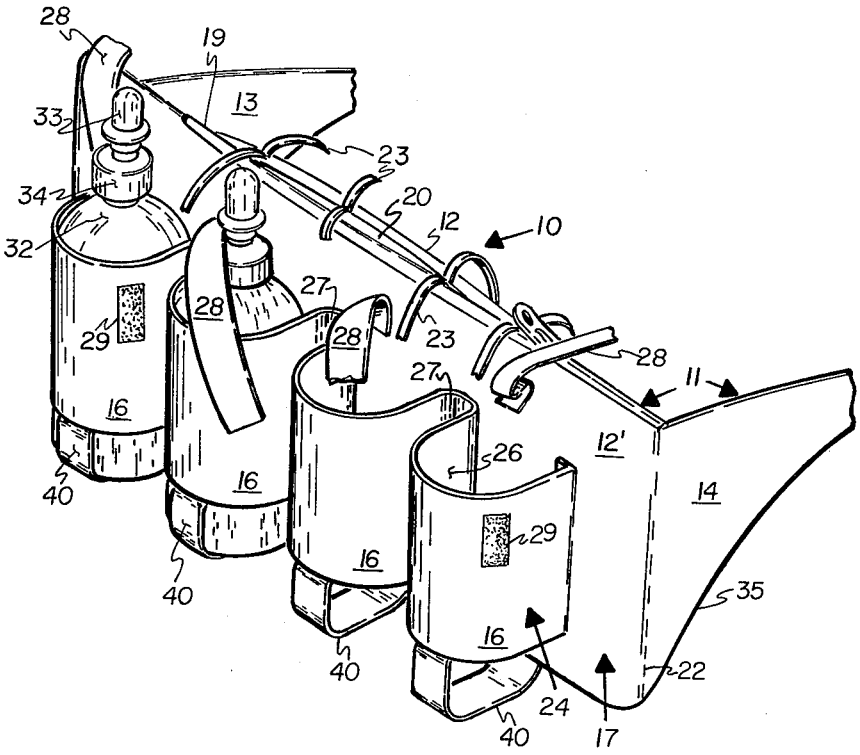
FIG. 4 is a perspective view of the backpack of the invention in a preferred embodiment.

In the preferred embodiment, pockets 16 are open at the bottom as well as at the top, which readily facilitates cleaning in the event of spillage, or normal soiling caused by use of the backpack. Because pockets 16 are open at the bottom, means are required for supporting the bottles or other items carried in pockets 16. In the preferred embodiment, the necessary support is provided by at least one broad strap 40 affixed across the bottom of each pocket 16. As shown in FIG. 4, one end of strap 40 is affixed to the base of panel 17 and the other end is affixed to the bottom of pocket 16.

Alternatively, as shown in FIG. 1, the bottles or other items carried in pockets 16 are supported by shelf 15 which is affixed to and extends substantially normal to the bottom of the central portion of belt 10. Due to the nature of the construction of the backpack there is no necessity that shelf 15 be formed of a rigid material. Indeed, the same flexible material used for the other major elements of the backpack may also be used for shelf 15. Shelf 15 is held in semi-fixed relationship to pockets 16 by means of small straps 31 affixed to the base of the loop 26 forming each pocket 16.

Pockets 16 are particularly well adapted to carrying bottles 32. Bottles 32 are preferable of flexible plastic of the type known as "squeeze bottles." They have a tube (not shown in the drawing) passing through the screw cap 34 and extending to the base of the bottle. An easily removable pressure cap 33 on the tube prevents spillage. Bottles of this type permit the taking of liquid therefrom without tilting the head and are advantageously suited for use by long distance runners. Such bottles are commercially available and are as such no part of the present invention. However, the combination of the use of such bottles with the backpack described herein is a part of the present invention.

Attention is now drawn to the tapered sections 13 and 14 of belt 10. Sections 13 and 14 are adapted to permit the backpack to be worn at waist level without causing undue rubbing or chafing with the top of the pelvic bone. This function is accomplished by means of the concave arcuate taper 35 at the base of each tapered section. It will be readily apparent that avoidance of rubbing or chafing is of prime importance to the long distance runner or skier or indeed for anyone seeking to travel long distances wearing the pack. Moreover, there is no necessity that the backpack be worn at waist level. It can be readily secured about any part of the midriff. Thus, some will prefer to wear it low on the hips.

The combination of the use of panels 11 and 17 and the use of vertical stitching 22 results in the formation of an additional small compartment in tapered sections 13 and 14. Access to such compartments is provided by, for example, slit 25 in tapered section 14. It will be apparent that such access permits the small tapered compartments to be used for storage of tissues, or other small items as desired.

The foregoing description of preferred embodiments of the invention has been presented for purposes of illustration and description. It is not intended to be exhaustive or to limit the invention to the precise form disclosed, and obviously many modifications and variations are possible in light of the above teaching. These embodiments were chosen and described in order to best explain the principles of the invention and its practical application to thereby enable others skilled in the art to best utilize the invention in various embodiments and with various modifications as are suited to the particular use of the invention as set forth herein. This description sets forth the best mode presently contemplated for the practice of the invention. Finally, it is intended that the scope of the invention be defined by the claims appended hereto.

What I claim is:

1. A belt-support fluid-carrying backpack adapted to be secured around the midriff which comprises in combination (a) an alongated flexible belt having a relatively wide intermediate section and sections tapering from said intermediate section to straps forming the free ends of said belt, (b) fastener means at at least one of the free ends of said belt for releasing and adjustably securing said free ends together, (c) a plurality of substantially vertical, open topped, open bottomed pockets affixed to said intermediate section of said belt, said pockets adapted to provide easy access thereto for removal and replacement of objects carried therein by the person carrying the pack while said person is running, walking, or skiing, (d) means at the base of said pockets for supporting objects in place in said pockets, and (f) a plurality of potable fluid-carrying containers in place in said pockets.

2. The backpack of claim 1 wherein said intermediate section of said belt has affixed thereto a plurality of straps, each of said straps being affixed to said intermediate region near one top edge of a pocket affixed to said intermediate region, and the free end of each said strap and a portion of each said pocket diagonally across from the area of said intermediate region of said belt to which each said strap is affixed have fastener means for fastening each said strap to each said pocket.

3. The backpack of claim 2 wherein said fastening means comprises a strip of thistle cloth affixed to the outside of each said pocket and a strip of thistle cloth hooks affixed near the free end of each said strap.

4. The backpack of claim 1 wherein said pockets are formed from a single flexible member affixed in spaced loops to said intermediate region of said belt, said intermediate section of said belt defining the inner wall of said pockets.

5. The backpack of claim 1 wherein said intermediate section and said tapering sections of said belt are formed of two panels affixed to each other in mirror image to form a flat compartment with an access opening to said compartment along the top of said intermediate section, said access opening having a zipper member for opening and closing said access opening.

6. The backpack of claim 5 having a foam cushion pad inserted in said flat compartment which conforms substantially to the dimensions of said compartment.

7. The backpack of claim 5 wherein said flat compartment has a plurality of substantially equally spaced tie straps affixed to one inner wall thereof closely adjacent to said zipper member in said access opening.

8. The backpack of claim 1, 2, 3, 4, 5, 6, or 7 wherein said means for supporting objects in place in said pockets comprises at least one broad strap affixed across the base of each said pocket.

9. The backpack of claim 1, 2, 3, 4, 5, 6, or 7 wherein said means for supporting objects in place in said pockets comprises a shelf of flexible material affixed to the base of said intermediate section of said belt and extending substantially normal thereto, said shelf being held in substantially fixed spaced relationship to the open bottoms of said pockets by a plurality of straps affixed to said pockets and said shelf, whereby said shelf serves as the base support for objects carried in said pockets.

10. The backpack of claim 1, 2, 3, 4, 5, 6, or 7 wherein said tapering sections of said belt have a concave arcuate lower taper adapted to permit said belt to be fastened at waist level without undue rubbing or chafing of said belt on the pelvic bone.

11. A belt-supported backpack adapted to be secured around the midriff which comprises in combination (a) an elongated flexible belt having a relatively wide intermediate section and sections tapering from said intermediate section to straps forming the free ends of said belt, said intermediate section and said tapering sections being formed from two panels affixed to each other in mirror image to form a flat compartment with an access opening along the top of said intermediate section, said access opening having means for opening and closing it, (b) fastener means at at least one of the free ends of said belt for releasing and adjustably securing said free ends together, (c) a plurality of substantially equally spaced tie straps affixed to an inner wall of said flat compartment closely adjacent to the means for opening and closing said opening, (d) a plurality of substantially vertical, substantially equally spaced, open topped and open bottomed, pockets adapted to serve as bottle holders, (e) means at the base of said pockets for supporting objects in place in said pockets, (f) a plurality of straps affixed to said intermediate region of said belt, each of said straps being affixed to said intermediate region near a top edge of a pocket, and the free end of each said strap and a portion of each said pocket diagonally across from the area of said intermediate region of said belt to which each said strap is affixed have fastener means for fastening each said strap to each said pocket, and (g) a plurality of flexible bottles carried in said pockets.

* * * * *